US005151673A

United States Patent [19]

Waarren

[11] Patent Number: 5,151,673

[45] Date of Patent: Sep. 29, 1992

[54] COMPACT BEND FOR $TE_{01}$ MODE CIRCULAR OVERMODED WAVEGUIDE

[75] Inventor: Jeffery W. Waarren, Ellicott City, Md.

[73] Assignee: The Johns Hopkins University, Baltimore, Md.

[21] Appl. No.: 736,846

[22] Filed: Jul. 29, 1991

[51] Int. Cl.[5] ..... H01P 1/02

[52] U.S. Cl. ..... 333/249; 333/21 R

[58] Field of Search ..... 333/21 R, 249

[56] References Cited

U.S. PATENT DOCUMENTS

| | | | |
|---|---|---|---|
| 2,706,278 | 4/1955 | Walker | 333/249 |
| 2,859,412 | 11/1958 | Marie | 333/21 R |
| 2,899,651 | 8/1959 | Lanciani | 333/21 R |

OTHER PUBLICATIONS

Montgomery et al., *Principles of Microwave Circuits*, Rad. Lab Series 8, McGraw-Hill, 1948, Title page & pp. 339, 340.

*Primary Examiner*—Paul Gensler

*Attorney, Agent, or Firm*—Francis A. Cooch; Robert E. Archibald

[57] ABSTRACT

A compact waveguide bend structure having high power handling capability, particularly designed for use with $TE_{01}$ circular overmoded waveguide, comprises a transition from circular overmoded waveguide to rectangular overmoded waveguide (using the $TE_{20}$ mode), followed by a $TE_{20}$ mode rectangular waveguide bend, and a transition back to circular overmoded waveguide.

5 Claims, 2 Drawing Sheets

COMPACT BEND FOR $TE_{01}$ MODE CIRCULAR OVERMODED WAVEGUIDE

STATEMENT OF GOVERNMENTAL INTEREST

This invention was made with Government support under Contract No. N00039-87-C-5301 awarded by the U.S. Navy Department. The Government has certain rights in this invention.

BACKGROUND OF THE INVENTION

The most common type of waveguide propagates signals in only one specific electromagnetic field pattern or mode, out of an infinite number of possible modes. Single-mode operation occurs because the waveguide is designed so that signals are in a frequency band which is sufficiently low that only the mode with the lowest "cutoff frequency" can exist and no other mode can propagate. If other modes were allowed to propagate, signal energy could couple into and out of various modes substantially distorting the signal. Such "conventional waveguide" is compact and easy to design, model and use. Unfortunately, maintaining only the lowest-cutoff mode in a given frequency band requires restriction of the waveguide cross section dimensions, and this, in turn, restricts power carrying capacity and limits the lowest achievable signal attenuation. As a result, design of some systems requiring microwave or millimeter wave signal transmission with high power or very low loss may be difficult or impractical.

An alternative type of waveguide is generally called "overmoded" in which a higher order mode is used, i.e. a mode which does not have the lowest cutoff frequency. Because other (unwanted) modes are also capable of existing as well as the desired transmission mode, this type of waveguide must feature internal structures which suppress the unwanted modes. Because internal structure, rather than restriction of cross section dimensions, is the basis for suppressing all but the desired mode, overmoded waveguide cross section can, in principle, be made arbitrarily large for a corresponding increase in power capacity and decrease in signal attenuation. Unfortunately, this type of waveguide, with unwanted mode suppression, is difficult to model and design, and its cross-sectional dimensions may not be amenable to compactness without significant design optimization.

Historically, the more successful type of overmoded waveguide supports the circular $TE_{01}$ mode and uses either a dielectric lining or dielectric sheathed helix of insulated wire inside the circular cross section waveguide for suppression and decoupling of unwanted modes, e.g. see A. E. Karbowiak "Trunk Waveguide Communication", Chapmen and Hall Ltd. 1965. Both versions of overmoded $TE_{01}$ waveguide were originally developed and tested for millimeter band (60–100 GHz) trunk line telecommunications between cities. Application of overmoded waveguide technology for high power and/or low loss transmission in microwave or millimeter wave radio communications an radar has also been suggested and developed to a limited degree, e.g. see R. M. Collins "Practical Aspects of High Power Circular Waveguide Systems" NEREM Record, Session 24, pp 182–183,(1962).

Because transmitters, receivers, and antennas normally use standard rectangular waveguide, various transition structures have been developed for interconnecting circular overmoded waveguide and the rectangular waveguide. For example, the well-known Marie transducer has one circular waveguide port and one rectangular waveguide port, and it is referred to as a transducer because it changes the mode of propagation from circular $TE_{01}$ to rectangular $TE_{10}$. Another transition, called a multiport transducer, has one circular waveguide port and multiple rectangular waveguide ports. The primary advantage of a multiport transducer is that it can handle higher power levels than the Marie transducer. A detailed description of such a multiport device is contained in U.S. Pat. No. 4,628,287.

Waveguide bends are also required for practical overmoded waveguide systems, and several bend structures have previously been proposed. More specifically, a bend could be constructed from helical waveguide; however, such a device must be relatively large to prevent mode conversion. In practice, a 90° helical waveguide bend for S-band application has been fabricated that is approximately eight feet long. For certain applications, such as shipboard use, this is still much larger than desired, and further size reductions are probably not possible without incurring unacceptable losses. Moreover, helical waveguide bends tend to be very expensive to fabricate.

Another type of bend proposed for overmoded waveguide application involves the use of a pair of multiport transducers interconnected by a plurality of rectangular waveguides that are bent at the desired angle, see U.S. Pat. No. 4,679,008. This bend has higher power handling capability than the Marie-based bend, but it requires precise rectangular bend configurations to maintain proper phasing if more than two rectangular waveguides are used.

SUMMARY OF THE INVENTION

The novel bend structure proposed in accordance with the present invention offers high power handling capability, yet it is compact, lightweight, rugged and relatively inexpensive to manufacture. It basically comprises a transition from circular overmoded waveguide to rectangular overmoded waveguide (using the $TE_{20}$ mode), followed by a $TE_{20}$ mode rectangular waveguide bend, and a transition back to circular overmoded waveguide.

The main object of the present invention is to provide a bend structure for overmoded waveguide applications which has high power handling capability, yet is compact, lightweight, rugged and relatively inexpensive to manufacture.

Other objects, purposes and characteristics of the present invention will be pointed out or be obvious as the description of the invention progresses, with reference to the accompanying drawings wherein.

Figure 2:
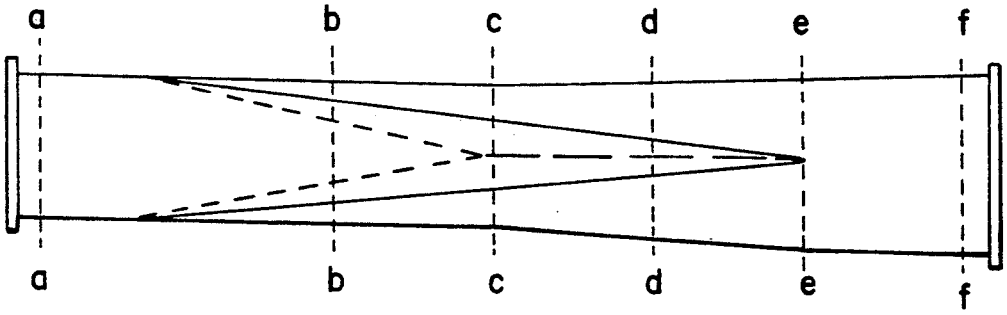
FIG. 2 is a simplified side plan view of each of the waveguide transition sections of the bend structure of FIG. 1.
Figure 3A:
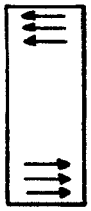
Figure 3B:
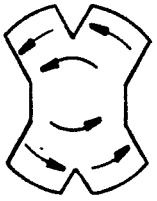
Figure 3C:
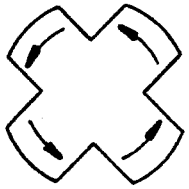
Figure 3D:
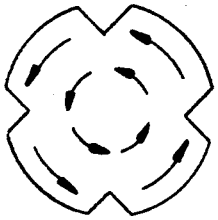
Figure 3E:
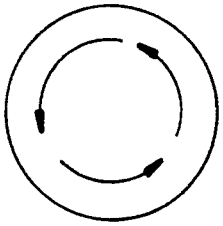
Figure 3F:
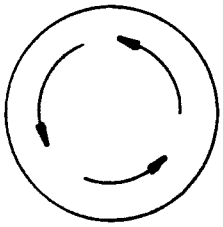
Figure 4:
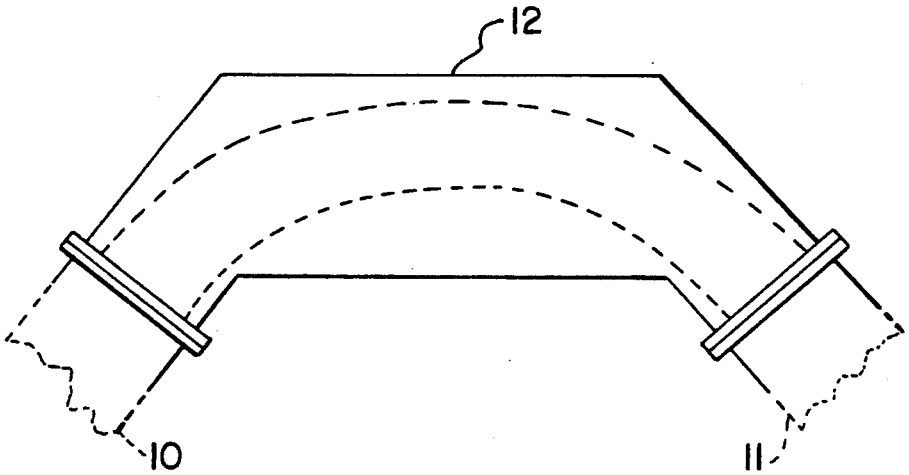

FIGS. 3*a* through 3*f* comprise a diagrammatic illustration of a series of cross-sectional views of the waveguide transition section, taken along lines a—a through f—f in FIG. 2 and showing the electric field distribution therein; and FIG. 4 is a top plan view of p e rectangular bend section of the proposed structure.

Figure 1:
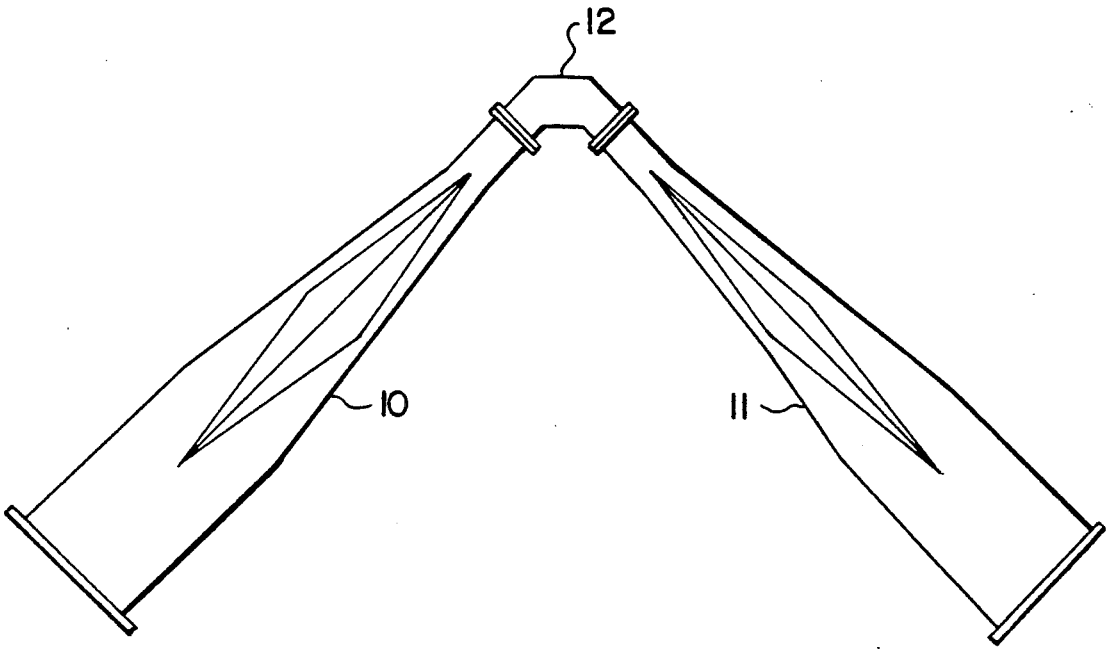
FIG. 1 is a top plan view of the proposed bend structure.

Referring first to FIG. 1, the proposed bend structure comprises pair of circular rectangular waveguide transition sections 10 and 11 which each transition between circular and rectangular TE $_{20}$ waveguide and which are interconnected at 90° by a $TE_{20}$ mode rectangular waveguide bend section 12. The rectangular waveguide bend section 12 is similar to a standard rectangular waveguide bend, except that the waveguide is twice as wide as a standard waveguide. In one practical embodiment, the bend section 12 was fabricated by machining an aluminum block with an internal curved waveguide aperture (shown by dashed line in FIG. 4), of rectangular cross-section, and having a radius of curvature of about four inches, thus producing a very compact structure. A somewhat larger radius of curvature (of possibly twelve inches) would likely produce even better performance and would be acceptable for many applications. Moreover, although both E- and H-plane bends are possible, an E-plane bend would normally be used because an H-plane bend would tend to be much larger and thus less compact.

The structure and operation of the proposed bend structure of the present invention can best be understood by reference to the series of cross-sectional views shown in FIGS. 3*a* through 3*f*. The circular $TE_{01}$ mode input (or output) of the transition sections 10 and 11 is shown at FIG. 3*f*, and the rectangular $TE_{20}$ mode output (or input) of the waveguide bend section 12 is shown at FIG. 3*a*. Between FIGS. 3*f* and 3*e*, the diameter of the waveguide tapers down without changing the mode of propagation, and the diameter at cross-section line e—e in FIG. 2 is typically made small enough to place the $TE_{41}$ mode in cutoff, since it could couple well into the cruciform section (section c—c) which is gradually achieved as shown in FIGS. 3*c* and 3*d*. The width of each of the four arms of the cruciform at section c—c is typically equal to the narrow dimension of the appropriate rectangular waveguide. Preferably, the diameter of the cylinder circumscribing the waveguide is held substantially constant between sections e—e and c—c, as shown in FIG. 3, but then tapers slightly between sections c—c and a—a, while the cruciform becomes a rectangle. The wide side of section a—a is typically twice as long as the wide side of a standard rectangular waveguide. As noted previously, the distribution of the electric fields within each transition section is represented diagrammatically by the arrows in FIGS. 3*a* and 3*f*.

Various modifications, adaptations and alterations to the illustrated embodiment will of course be obvious to one of ordinary skill in the art in light of the foregoing description and accompanying drawings. It should thus be understood that within the scope of the appended claims, the present invention may practiced otherwise than as specifically set forth hereinabove.

I claim:

1. A compact bend structure for use with $TE_{01}$ mode circular overmoded waveguide, comprising:

first and second waveguide transition sections, each configured as a circular waveguide at one end for circular $TE_{01}$ mode operation and transitioning into a single rectangular waveguide for rectangular $TE_{20}$ mode operation at its other end, and a $TE_{20}$ mode rectangular waveguide bend section connecting the said other ends of said first and second waveguide transition sections together at a desired angle relative to one another.

2. The compact bend structure specified in claim 1 wherein said waveguide bend section connects said first and second waveguide transition sections at 90° relative to one another.

3. The compact bend structure specified in claim 1 wherein each of said waveguide transition sections is configured to gradually transition the rectangular end into a cruciform cross-section and subsequently into a circular cross-section.

4. The compact bend structure specified in claim 3 wherein the diameter of said circular cross-section is small enough to place the $TE_{41}$ mode in cut-off to prevent its coupling into said cruciform cross-section.

5. The compact bend structure specified in claim 1 wherein said waveguide bend section is formed of aluminum with an internal curved waveguide aperture of rectangular cross-section supporting $TE_{20}$ mode operation.

* * * * *

UNITED STATES PATENT AND TRADEMARK OFFICE

CERTIFICATE OF CORRECTION

PATENT NO. : 5,151,673

DATED : September 29, 1992

INVENTOR(S) : Jeffery W. Warren

It is certified that error appears in the above—identified patent and that said Letters Patent is hereby corrected as shown below:

Title page, item [19] and [54] " Waaren" should read --Warren--.

Signed and Sealed this

Fourteenth Day of September, 1993

Bruce Lehman

*Attest:*

BRUCE LEHMAN

*Attesting Officer*

*Commissioner of Patents and Trademarks*